US007771222B2

(12) United States Patent
Li et al.

(10) Patent No.: US 7,771,222 B2
(45) Date of Patent: Aug. 10, 2010

(54) CARD EDGE CONNECTOR

(75) Inventors: Hua Li, Kunshan (CN); Zhen-Hua Wang, Kunshan (CN); Li-Meng Feng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 243 days.

(21) Appl. No.: 12/005,800

(22) Filed: Dec. 27, 2007

(65) Prior Publication Data

US 2008/0160792 A1 Jul. 3, 2008

(30) Foreign Application Priority Data

Dec. 29, 2006 (CN) ..... 200620152381

(51) Int. Cl.
*H01R 13/62* (2006.01)

(52) U.S. Cl. ..... 439/326; 439/636

(58) Field of Classification Search ..... 439/326, 439/328, 636, 637

See application file for complete search history.

(56) References Cited

U.S. PATENT DOCUMENTS

| | | | | |
|---|---|---|---|---|
| 5,393,234 | A | 2/1995 | Yamada et al. | |
| 6,024,592 | A * | 2/2000 | Pai et al. | 439/326 |
| 6,030,245 | A * | 2/2000 | Choy | 439/328 |
| 6,146,177 | A * | 11/2000 | Wu | 439/326 |
| 6,164,998 | A * | 12/2000 | Poi et al. | 439/326 |
| 6,726,499 | B1 * | 4/2004 | Yu | 439/328 |
| 6,890,202 | B2 * | 5/2005 | Yasufuku et al. | 439/331 |

* cited by examiner

*Primary Examiner*—Hien Vu
(74) *Attorney, Agent, or Firm*—Andrew C. Cheng; Wei Te Chung; Ming Chieh Chang

(57) ABSTRACT

A card edge connector adapted for rotatably receiving a larger daughter board to a mother board includes an insulating housing defining an elongated slot therein, a plurality of contacts received in the housing, a pair of stopping arms setting to the ends of the housing respectively and a supporting wall integrating with the stopping arm and being longer near to the stopping arm. The stopping arms and the supporting walls are immovable when the daughter board rotating.

6 Claims, 4 Drawing Sheets

CARD EDGE CONNECTOR

BACKGROUND OF THE INVENTION

1. Field of the Invention

The present invention generally relates to an electrical connector, and particularly to a card edge connector for connecting a daughter board, such as a card memory module, to a mother board.

2. Description of Prior Arts

A conventional card edge connector generally includes an insulating housing defining an elongated slot for receiving a daughter card, and a plurality of contacts received along two opposite inner walls of the slot. A pair of latching arms extend from two opposite ends of the housing. A supporting portion is defined below and inside the latching arm and has a top supporting plane parallel to the lower inner wall of the slot so as to support the daughter card. Two types of the latching arm and supporting portion are generally used in application. One type is that the supporting portion is short so that the latching provides enough elasticity. The second type is that the supporting portion is long, may be as long as the latching arm, but must separate from the latching arm so that the latching arm can pivot outwards to provide elasticity.

However, when a larger daughter board, that is much longer than the latching arms, is inserted in a connector of said first type, the larger daughter board can not be supported nicely by the short supporting portion, maybe it will slope down. The daughter board also will shift transversely if the daughter board is inserted into a connector of said second type, since the longer latching arm is easy move transversely. U.S. Pat. No. 5,393,234 discloses a new type of connector defines a latching arm without elasticity, however, and the daughter board is inserted into the slot parallel. Corresponding, the contacts for parallel insertion are different from that of rotatably insertion of the daughter board. In convention mass-production, cost-down current, re-design a new mould to adapt to desire the connector of U.S. Pat. No. 5,393,234 is not ideal. Hence, we hope to desire a new connector on the basis of current connector with most less change.

BRIEF SUMMARY OF THE INVENTION

It is an object of the present invention to provide a lower-inserting force card edge connector used for receiving a larger daughter board.

It is another object of the present invention to provide a card edge connector for receiving and retaining a daughter board steadily.

In order to obtain the objective above, a card edge connector adapted for rotatably receiving a larger daughter board to a mother board includes an insulating housing defining an elongated slot therein, a plurality of contacts received in the housing, a pair of stopping arms setting to the ends of the housing respectively and a supporting wall integrating with the stopping arm and being longer near to the stopping arm. The stopping arms and the supporting walls are immovable when the daughter board rotating.

Other objects, advantages and novel feature of the invention will become more apparent from the following detailed description of the present embodiment when taken in conjunction with the accompanying drawings.

BRIEF DESCRIPTION OF THE DRAWINGS

FIG. 3 shows the daughter board is positioned at a first position, and FIG. 4 shows the daughter board is positioned at a second position.

DETAILED DESCRIPTION OF THE INVENTION

Figure 1:
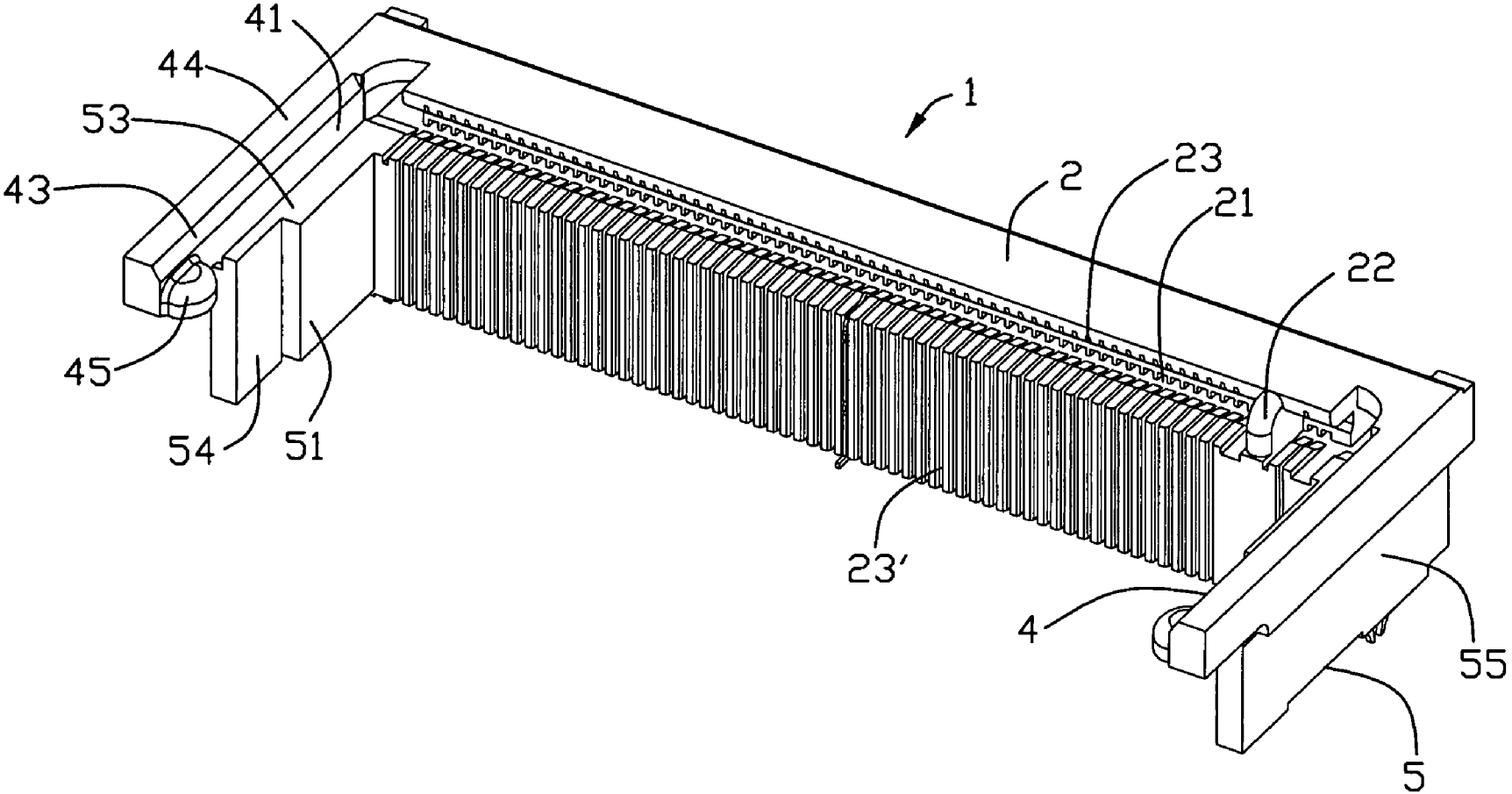
FIG. 1 is a front side perspective view of a card edge connector constructed in accordance with the present invention.

Reference will now be made to the drawing figures to describe the present invention in detail.

Figure 2:
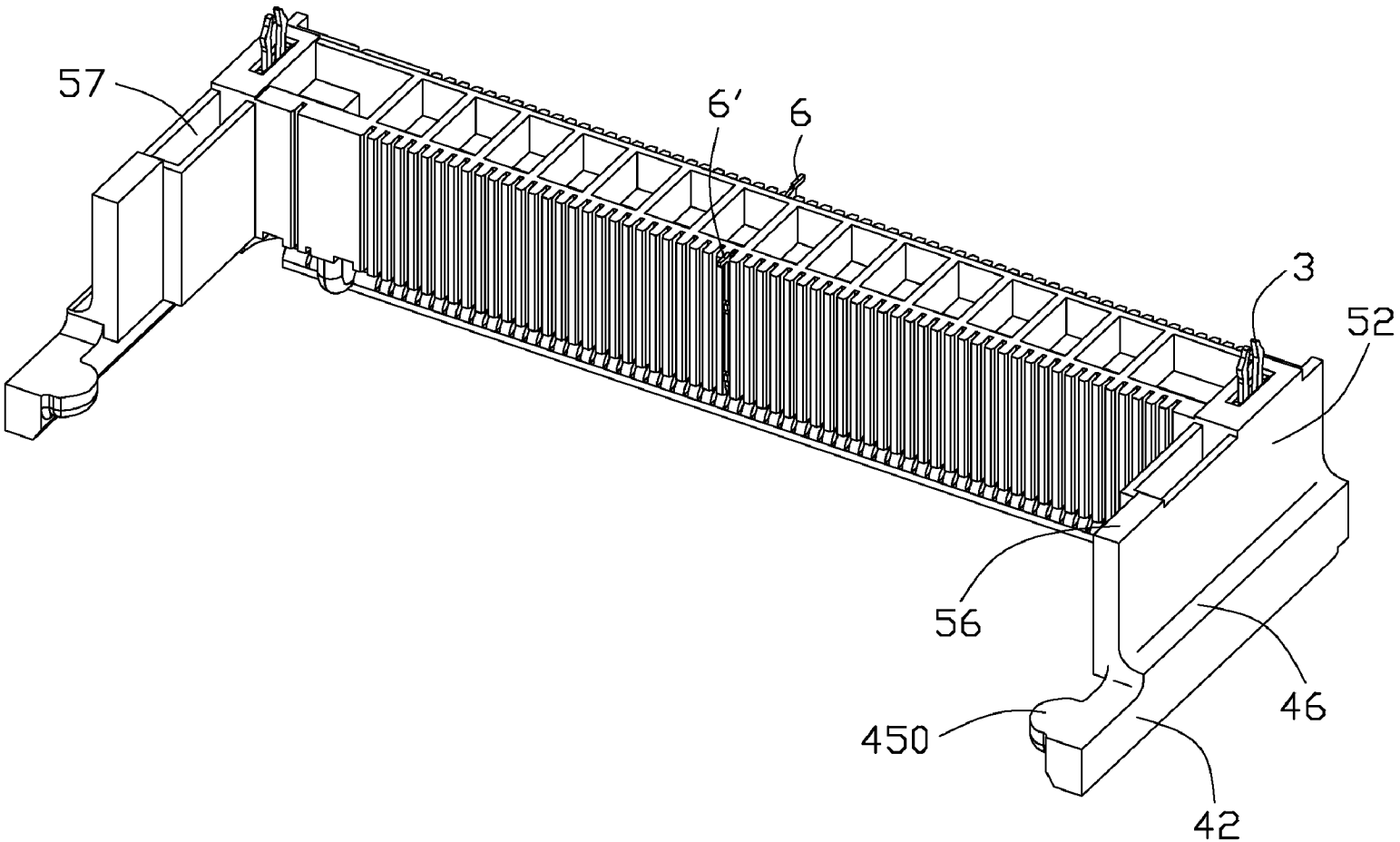
FIG. 2 is a bottom perspective view of the card edge connector of FIG. 1.

With reference to FIGS. 1 and 2, a card edge connector constructed in accordance with the present invention, generally designated with reference number 1 is used for rotatablely receiving a larger daughter board 7, and comprises an elongated housing 2 made of insulative material, such as plastics, with an elongated slot 21 defined therein for receiving a releasing edge of the larger daughter board. Two rows of contact-receiving channels 23 and 23' are defined along upper and lower inner walls of the elongated slot 21 to receive a plurality of contacts 6 and 6' (only a pair is shown in FIGS. 1 and 2). Each contacts comprises a retaining section retained in the housing, a contacting section extending into the slot 21 and a soldering section extending out the bottom surface of the housing. A key 22 is positioned in the elongated slot 21 and integrally formed with the housing 2. The daughter card is inserted into the elongated slot 21 with its notch 70 properly aligning with the key 22. Two fixing members 3 are retained in the ends of the bottom surface of the housing 2 respectively for being inserted and soldered into a mother board (not shown) where the connector is mounted, thereby increasing the reliability of the connector mounted on the mother board.

A pair of stopping arms 4 integrally extend from two opposite ends of the housing 2. The stopping arms 4 respectively define an inner surface 41 facing to each other, and an outer surface 42 parallel to the inner surface 41. A slanting surface 43 is formed at the intersect of an top surface 44 and the inner surface 41, thereby protecting the stopping arm 4 from being scraped scratched when the daughter board is inserted into the slot 21, especially when inserted incorrectly. The stopping arms 4 each has an inward protrusion 45 respectively at the distal end thereof, which face each other and have a same height as the elongated slot 21. The protrusion 45 is also defined and served as a locking lug.

The card edge connector 1 further comprises a pair of supporting walls 5 integrally extending from the opposite ends of the housing 2. The supporting wall 5 also integrates with the stopping arm 4 which is long enough to reach to the stopping arm 4. The supporting walls 5 respectively define an inner face 51 facing each other, an outer face 52 parallel to the inner surface 51 and a second bottom face 56 connecting the inner face 51 and the outer face 52. The top of the supporting wall 5, which is defined as a supporting face 53, is as high as the lower inner wall of the slot 21 so as to support the daughter board. A front portion of the supporting wall 5 is partially cut-off to define a receiving room 54. The outer surface 42 of the stopping arm 4 projects outward beyond the outer face 52 of the supporting wall 5 to define a receiving room 55 below the stopping arm 4. Therefore, said receiving room 54 and 55 is adapted for receiving other component. The second bottom face 56 of the supporting wall is disposed below a first bottom face 46 of stopping arm 4 and defines a groove 57 for saving material. Each supporting wall 5 is defined as an upward supporting platform, and an upper face of the supporting platform is defined as the supporting face 53. The supporting platform integrally with the stopping arm 4 is defined as a side arm, and a bottom face 450 of the locking lug 45 is essentially coplanar with the supporting face 53.

Figure 3:
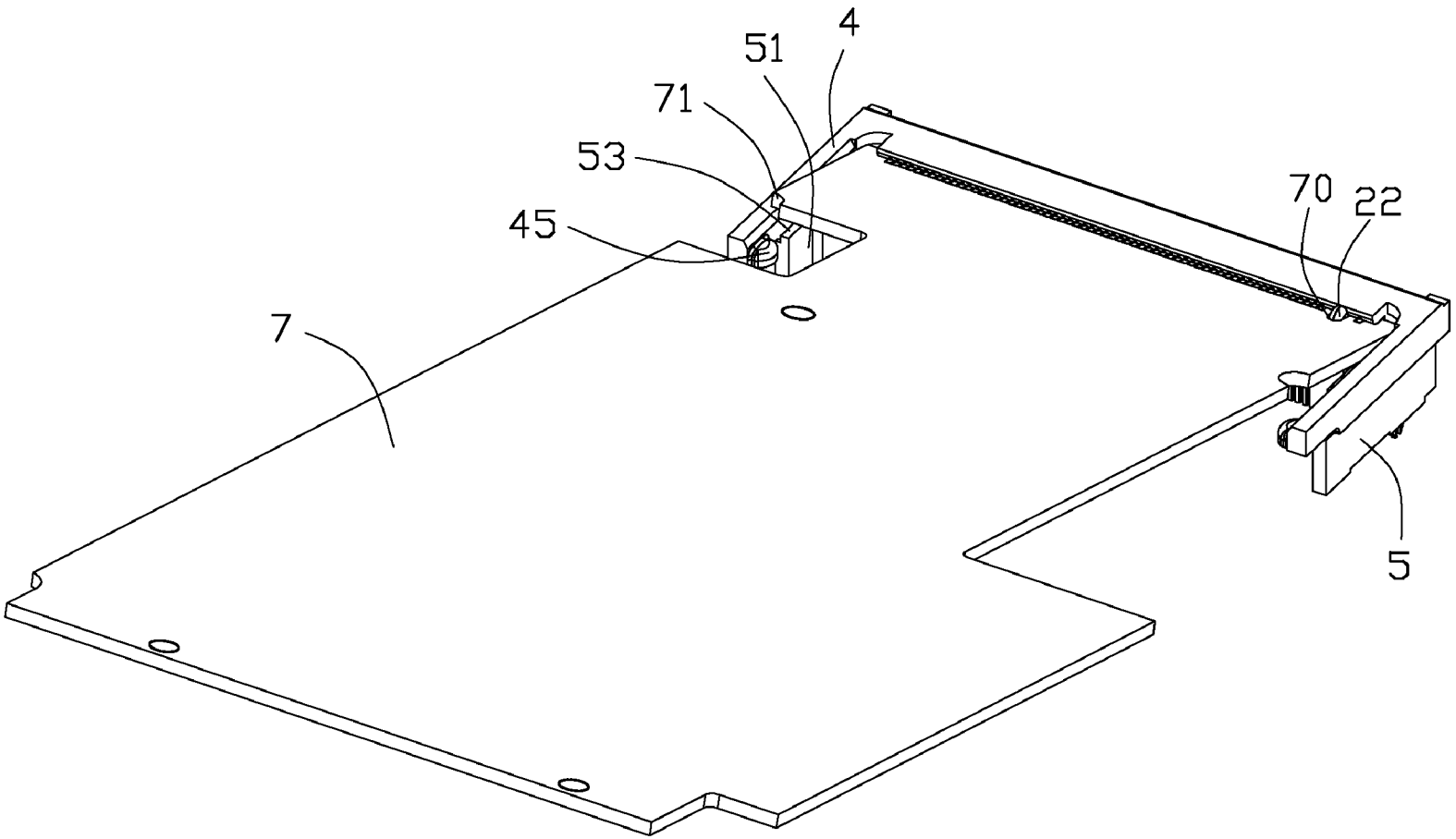
FIG. 3 and FIG. 4 are perspective views of the card edge connector retaining a daughter board therein.
Figure 4:
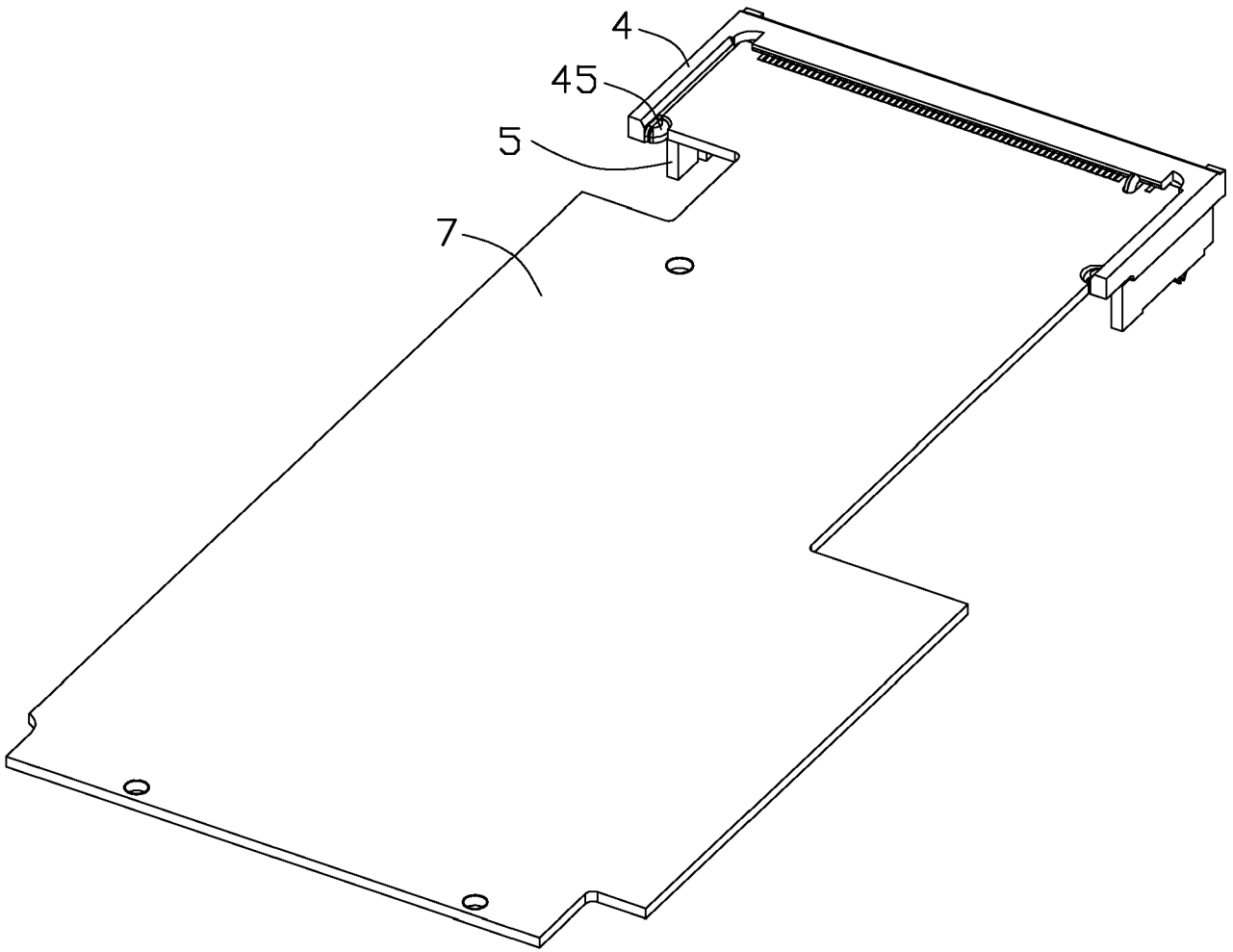

Referring to FIG. 3 and FIG. 4, when put the releasing edge of the daughter board into the slot 21, and the daughter board 7 is firstly positioned at a first position and oblique to the mother board, and then is rotated such that a front end of the daughter board is moved downwards until the daughter board is positioned at a second position in which the daughter board is parallel to the mother board and abuts against the supporting face 53, and the projections 45 enter into corresponding concaves 71 at sides of the daughter board. Then a latching device (not shown), such as some bolts, is used to lock the front end of the daughter board to the mother board to latch the daughter board in an up-and-down direction. If the daughter board is not inserted completely into the slot 21, the protrusions 45 of the stopping arms 4 will stop the daughter board from further moving downwardly. The entrance of the protrusions 45 into the corresponding concaves 71 at sides of the daughter board is to prevent relative movement of the daughter board 7 in a front-to-back direction, and the side arms are immoveable relative to the housing during the rotation of the daughter board between the first and second positions. The card edge connector 1 is not integrally equipped with any part which is used to latch the daughter board 7 in the up-and-down direction.

The stopping arms 4 is integrally formed with the supporting wall 5, so the daughter board, especially the larger daughter board position in the connector surely and do not shift transversely. The supporting wall 5 is long enough to support the daughter board, thereby increasing the reliability of daughter board.

It is to be understood, however, that even though numerous characteristics and advantages of the present invention have been set form in the foregoing description, together with details of the structure and function of the invention, the disclosure is illustrative only, and changes may be made in detail, especially in matters of number, shape, size, and arrangement of parts within the principles of the invention to the full extent indicated by the board general meaning of the terms in which the appended claims are expressed.

We claim:

1. A card edge connector adapted for rotatablely receiving a larger daughter board to a mother board from a first position in which the daughter board is oblique to the mother board to a second position in which the daughter board is parallel to the mother board, and comprising:

an insulating housing defining an elongated slot therein;

a plurality of contacts received in the housing;

a pair of stopping arms setting to the ends of the housing respectively, and each defining a first bottom face thereof;

a pair of supporting walls each integrating with the stopping arm and being long enough to reach to the stopping arm, and each supporting wall extending downwards from the stopping arm and providing a second bottom face disposed lower than the first bottom face of the stopping arm; and wherein the stopping arms and the supporting walls are immovable relative to the housing during the rotation of the daughter board between the first position and second position;

wherein the stopping arm forms a slanting surface thereof to protect the stopping arm from being scraped by the daughter board;

wherein a front portion of the supporting wall is cut-out partially to define a receiving room; and wherein an outer surface of the stopping arm projects outward beyond an outer face of the supporting wall to define a receiving room below the stopping arm.

2. The card edge connector according to claim 1, wherein the stopping arms each has an inward protrusion disposed at the distal end thereof and in front of the supporting wall, and the protrusions face to each other.

3. The card edge connector according to claim 1, wherein the supporting wall defines a support face, which is as high as a lower inner wall of the slot to support the larger daughter board when the larger daughter board is disposed at the second position.

4. The card edge connector according to claim 1, wherein each supporting wall defines a groove recessing upwards from the second bottom face thereof.

5. A card edge connector for use with a daughter card, comprising:

an insulative housing defining an elongated base and two side arms extending forwardly at two opposite ends of the base under a condition that said side arms are immovable relative to the base;

a central slot formed in the base along a longitudinal direction and forwardly communicating with an exterior; and a plurality of contacts disposed in the housing with contacting sections extending into the central slot; wherein each of said side arms includes an upward supporting platform, a stopping arm integrating with an upper and outer portion of the supporting platform and a locking lug under a condition that the locking lug is dimensioned and configured to only prevent relative movement of the daughter card in a front-to-back direction perpendicular to said longitudinal direction, and the supporting platform further extends downwards and provides a second bottom face disposed lower than a first bottom face of the stopping arm, and said connector is not integrally equipped with any part which is used to latch the daughter card in an up-and-down direction;

wherein a bottom face of the locking lug is essentially coplanar with an upper a supporting face of the supporting platform;

wherein an outer surface of the stopping arm projects outward beyond an outer face of the supporting platform to define a receiving room below the stopping arm; and wherein a front portion of the supporting platform is cut-out partially to define a receiving room.

6. The card edge connector as claimed in claim 5, wherein the locking lug is provided at a distal end of the stopping arm and disposed in front of the supporting platform.

* * * * *